US007193370B2

(12) United States Patent
Kim

(10) Patent No.: US 7,193,370 B2
(45) Date of Patent: Mar. 20, 2007

(54) LIGHT EMITTING DISPLAY AND METHOD OF DRIVING THE SAME

(75) Inventor: Hong Kwon Kim, Euiwang-si (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 11/267,170

(22) Filed: Nov. 7, 2005

(65) Prior Publication Data

US 2006/0108937 A1 May 25, 2006

(30) Foreign Application Priority Data

Nov. 8, 2004 (KR) ..... 10-2004-0090182

(51) Int. Cl.
*G09G 3/10* (2006.01)

(52) U.S. Cl. ..... 315/169.1; 315/169.3; 345/78; 345/84; 345/204

(58) Field of Classification Search .. 315/169.1–169.3, 315/291, 307, 360; 345/76, 78, 89, 90, 92, 345/95, 98–101, 82, 84, 204
See application file for complete search history.

(56) References Cited

U.S. PATENT DOCUMENTS

2003/0043130 A1 3/2003 Kawasaki et al.
2005/0134536 A1* 6/2005 Lo ..... 345/76
2005/0275647 A1* 12/2005 Numao ..... 345/204
2006/0061529 A1* 3/2006 Kim ..... 345/87
2006/0077138 A1* 4/2006 Kim ..... 345/76
2006/0092107 A1* 5/2006 Kim ..... 345/76

FOREIGN PATENT DOCUMENTS

KR 2004-0021753 3/2004

* cited by examiner

*Primary Examiner*—Haissa Philogene
(74) *Attorney, Agent, or Firm*—H.C. Park & Associates, PLC

(57) ABSTRACT

A light emitting display, and a method of driving the same, including a plurality of pixels arranged in regions partitioned by a plurality of scan lines, a plurality of data lines, a plurality of compensating power source lines, which are supplied with compensating power sources, and a plurality of first power source lines. Each pixel includes a pixel circuit for outputting currents corresponding to the compensating power sources and data signals in a plurality of sub-frames included in a frame and an organic light emitting diode (OLED) that emits light corresponding to the current output from the pixel circuit.

30 Claims, 6 Drawing Sheets

LIGHT EMITTING DISPLAY AND METHOD OF DRIVING THE SAME

CROSS-REFERENCE TO RELATED APPLICATIONS

This application claims priority to and the benefit of Korean Patent Application No. 10-2004-0090182, filed on Nov. 8, 2004, which is hereby incorporated by reference for all purposes as if fully set forth herein.

BACKGROUND OF THE INVENTION

1. Field of the Invention

The present invention relates to a light emitting display, and more particularly to, a light emitting display that decreases non-uniformity in an image caused by a voltage drop in power source lines and a method of driving the same.

2. Discussion of the Background

Various thin and lightweight flat panel displays (FPD) have been developed to replace the heavier and bulkier cathode ray tubes (CRT). Such FPDs include liquid crystal displays (LCD), field emission displays (FED), plasma display panels (PDP), and light emitting displays.

Light emitting displays display images using an organic light emitting diode (OLED), which emits light by recombination of electrons and holes. The light emitting display may have a higher response speed than a display device that requires a light source, such as the LCD.

FIG. 1 is a circuit diagram showing a pixel of a common light emitting display.

Referring to FIG. 1, each pixel 11 of the common light emitting display is arranged corresponding to a crossing of a scan line Sn and a data line Dm. Applying a scan signal to the scan line Sn selects a pixel 111 to generate light corresponding to the data signal from the data line Dm.

Therefore, the pixel 11 includes a first power source ELVDD, a second power source ELVSS, an OLED, and a pixel circuit 40.

The anode of the OLED is connected to the pixel circuit 40, and the cathode of the OLED is connected to the second power source ELVSS.

In addition to an organic light emitting layer (EML), the OLED may include an electron transport layer (ETL) and a hole transport layer (HTL) formed between the anode and the cathode. The OLED may further include an electron injection layer (EIL) and a hole injection layer (HIL). When a voltage is applied between the anode and the cathode of the OLED, electrons generated by the cathode move to the EML through the EIL and the ETL, and holes generated by the anode move to the EML through the HIL and the HTL. Therefore, the electrons and holes supplied by the ETL and the HTL recombine in the EML to generate light.

The pixel circuit 40 includes first and second transistors M1 and M2 and a capacitor C. Here, the first and second transistors M1 and M2 are p-type metal-oxide semiconductor field effect transistors (MOSFET). The second power source ELVSS may have a lower voltage level than the first power source ELVDD such as, for example, a ground voltage level.

The gate electrode of the first transistor M1 is connected to the scan line Sn, its source electrode is connected to the data line Dm, and its drain electrode is connected to a first node N1. The first transistor M1 supplies the data signal from the data line Dm to the first node N1 in response to the scan signal from the scan line Sn.

The capacitor C stores a voltage corresponding to the data signal supplied to the first node N1 via the first transistor M1 in the period where the scan signal is supplied to the scan line Sn. When the first transistor M1 turns off, the capacitor C maintains the state in which the second transistor M2 is turned on in one frame.

The gate electrode of the second transistor M2 is connected to the first node N1, which is commonly connected to the drain electrode of the first transistor M1 and the capacitor C. The source electrode of the second transistor M2 is connected to the first power source ELVDD, and the drain electrode of the second transistor M2 is connected to the anode of the OLED. The second transistor M2 controls the amount of current supplied from the first power source ELVDD to the OLED in accordance with the data signal. Therefore, the OLED emits light by the current supplied from the first power source ELVDD via the second transistor M2.

To drive the pixel 11, the first transistor M1 is turned on in the period where a low level scan signal is supplied to the scan line Sn. Therefore, the data signal from the data line Dm is supplied to the gate electrode of the second transistor M2 via the first transistor M1 and the first node N1. At this time, the capacitor C stores the difference in voltage between the gate electrode of the second transistor M2 and the first power source ELVDD.

The second transistor M2 is turned on in accordance with the voltage of the first node N1 to supply current corresponding to the data signal to the OLED. Therefore, the OLED emits light according to the current supplied by the second transistor M2 to display images.

Then, in the period where a high level scan signal is supplied to the scan line Sn, the second transistor M2 is maintained to be turned on by the voltage corresponding to the data signal stored in the capacitor C so that the OLED emits light in one frame to display images.

The common light emitting display may additionally include a compensating circuit that compensates for non-uniform threshold voltages Vth of the second transistors M2 caused during fabrication. The light emitting display having the compensating circuit may utilize an offset compensating method or a current programming method, which have limitations on displaying uniform images.

SUMMARY OF THE INVENTION

The present invention provides a light emitting display that decreases non-uniformity in an image caused by a voltage drop in power source lines and a method of driving the same.

Additional features of the invention will be set forth in the description which follows, and in part will be apparent from the description, or may be learned by practice of the invention.

The present invention discloses a light emitting display including a plurality of pixels arranged in regions partitioned by a plurality of scan lines to which scan signals are supplied, a plurality of data lines to which data signals are supplied, a plurality of compensating is power source lines to which compensating power sources are supplied, and a plurality of first power source lines. Each pixel comprises a pixel circuit for outputting currents corresponding to the compensating power sources and the data signals in a plurality of sub-frames included in a frame and an organic light emitting diode (OLED) that emits light corresponding to the current output from the pixel circuit.

The present invention also discloses a light emitting display including an image display unit including a plurality of pixels arranged in regions partitioned by a plurality of scan lines, a plurality of data lines, a plurality of first power source lines, and a plurality of compensating power source lines. The pixels receive currents corresponding to compensating power sources supplied to the compensating power source lines and data signals supplied to the data lines from the first power source lines to emit light. A scan line driver supplies scan signals to the scan lines, a data driver supplies data signals to the data lines, a compensating power source supply unit supplies the compensating power sources corresponding to the sub-frames of a frame to the compensating power source lines, and a first power source supply unit supplies a first power source to the first power source-line.

The present invention also discloses a method of driving a light emitting display including a plurality of pixels arranged in regions partitioned by a plurality of scan lines, a plurality of data lines, a plurality of first power source lines, and a plurality of compensating power source lines. The method includes supplying compensating power sources having different voltage levels to the compensating power source lines in a plurality of sub-frames included in a frame, storing a compensating voltage between the compensating power source and a first power source supplied to the first power source line in a first capacitor included in a pixel, supplying data signals to the data lines, storing a voltage corresponding to the data signal and the compensating power source in a second capacitor included in the pixel, and supplying a current corresponding to the voltage stored in the second capacitor to an OLED.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
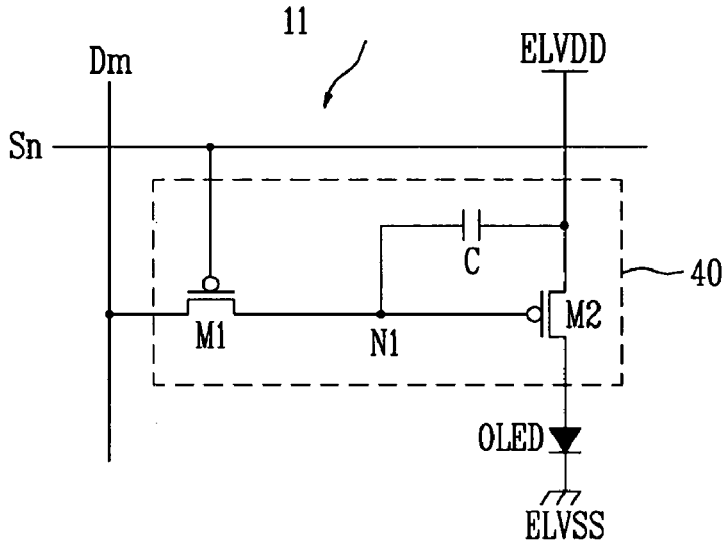
FIG. 1 (PRIOR ART)
FIG. 1 is a circuit diagram showing a pixel of a common light emitting display.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

Figure 2:
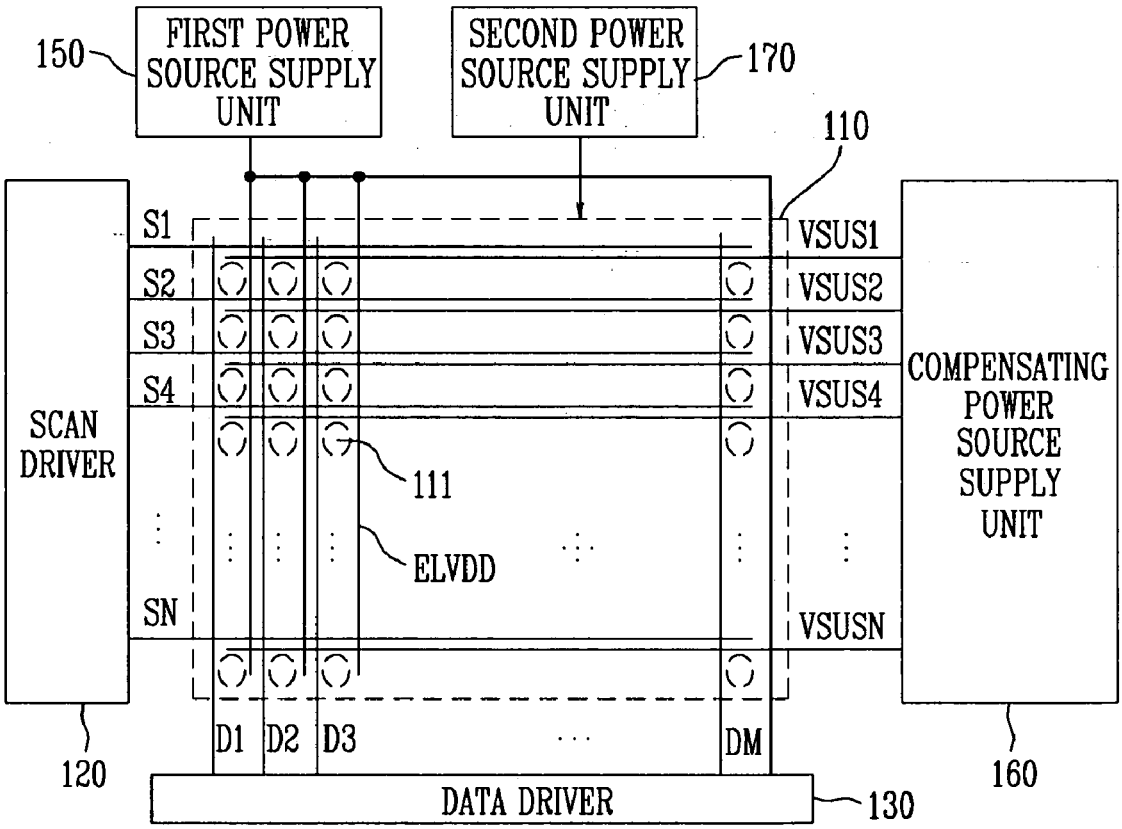
FIG. 2 shows a light emitting display according to a first exemplary embodiment of the present invention.

FIG. 2 shows a light emitting display according to a first exemplary embodiment of the present invention.

Referring to FIG. 2, the light emitting display includes an image display unit 110, a scan driver 120, a data driver 130, a first power source supply unit 150, a compensating power source supply unit 160, and a second power source supply unit 170.

The image display unit 110 includes a plurality of scan lines S1 to SN, a plurality of data lines D1 to DM, and a plurality of pixels 111 arranged in areas partitioned by a plurality of first power source lines ELVDD and a plurality of compensating power source lines VSUS1 to VSUSN. The first power source lines ELVDD are arranged substantially parallel with the data lines D1 to DM, and the plurality of compensating power source lines VSUS1 to VSUSN are arranged substantially parallel with the scan lines S1 to SN.

A pixel 111 is selected when scan signals are applied to the scan lines S1 to SN to generate light of predetermined brightness in response to digital data signals from the data lines D1 to DM. Specifically, each pixel 111 controls the brightness of an organic light emitting diode (OLED) in response to each bit of the digital data signals and the compensating power source from the compensating power source lines VSUS1 to VSUSN.

The scan driver 120 may sequentially supply the scan signals to the scan lines S1 to SN in response to scan control signals from a controller (not shown) such as, a start pulse and a clock signal.

The data driver 130 supplies i bit digital data signals to the pixels 111 through the data lines D1 to DM in response to data control signals supplied from the controller. That is, the data driver 130 supplies the i bit digital data signals to the data lines D1 to DM every j (j is a positive integer equal to or larger than i) sub-frames. Here, the digital data signals of the lowermost bit among the i bit digital data signals are supplied to a first sub-frame.

The first power source supply unit 150 generates a first power source to supply the first power source to the first power source lines ELVDD of the image display unit 110. Hence, the plurality of first power source lines ELVDD supply the first power source to the pixels 111.

The second power source supply unit 170 generates a second power source, which differs from the first power source, to supply the second power source to the second power source line of the image display unit 110. Here, the second power source line is electrically coupled with the cathodes of the pixels 111 formed on the entire surface of the image display unit 110.

The compensating power source supply unit 160 generates compensating power sources of different levels in the j sub-frames that constitute one frame. The compensating power source supply unit 160 sequentially supplies the compensating power source to the compensating power source lines VSUS1 to VSUSN in synchronization with the scan signals supplied to the scan lines S1 to SN. Here, the compensating power source has a higher level toward the uppermost bit of the i-bit digital data signals (see FIG. 6).

Figure 3:
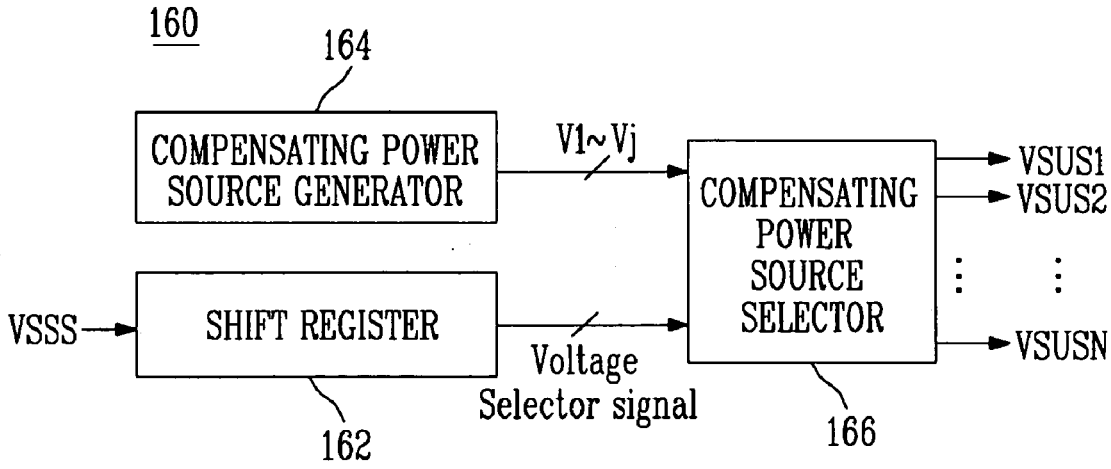
FIG. 3 is a block diagram showing the compensating power source supply unit of FIG. 2.

FIG. 3 is a block diagram showing the compensating power source supply unit 160 of FIG. 2.

Referring to FIG. 3, the compensating power source supply unit 160 includes a compensating power source generator 164, a shift register 162, and a compensating power source selector 166.

The compensating power source generator 164 generates compensating power sources V1 to Vj, which have different levels, to supply the compensating power sources to the compensating power source selector 166.

The shift register 162 includes a plurality of shift registers, which sequentially shift a power source selection start signal VSSS, supplied in synchronization with the scan signals, to supply the power source selection start signal VSSS to the compensating power source selector 166. At this time, the shift register 162 supplies a k-bit Voltage Selector Signal (k is a positive integer) to the compensating power source selector 166. Here, when a digital data signal has eight bits and a frame is composed of eight sub-frames, each shift register generates a three-bit Voltage Selector Signal to supply the power source selection signal to the compensating power source selector 166.

The compensating power source selector 166 includes a plurality of compensating power source selectors, and each compensating power source selector may be formed of an analog switch. Each compensating power source selector selects one of the plurality of compensating power sources V1 to Vj supplied by the compensating power source generator 164, in accordance with the Voltage Selector Signal supplied from each shift register, to sequentially supply the selected compensating power source to the plurality of compensating power source lines VSUS1 to VSUSN. The compensating power source is sequentially supplied from the compensating power source selector 166 to the plurality of compensating power source lines VSUS1 to VSUSN in synchronization with the scan signals supplied to the scan lines S1 to SN.

Figure 4:
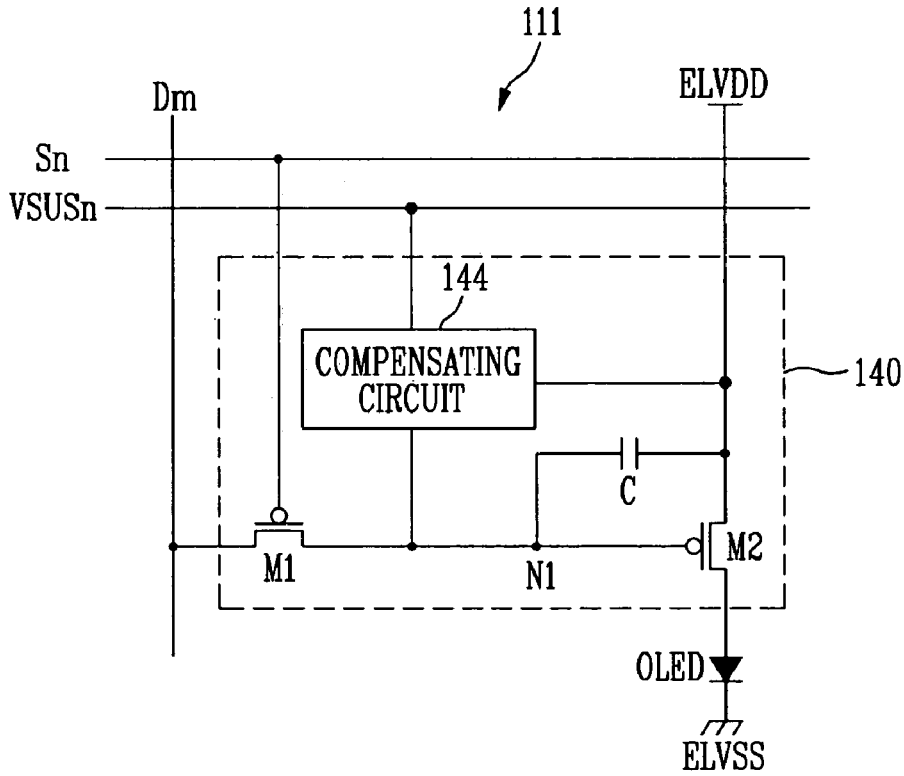
FIG. 4 is a pixel circuit showing a pixel of FIG. 2.

FIG. 4 is a circuit diagram showing a pixel of FIG. 2.

Referring to FIG. 4, each pixel 111 includes an OLED and a pixel circuit 140.

The anode of the OLED is coupled with the pixel circuit 140, and the cathode of the OLED is coupled with the second power source line ELVSS.

In addition to an organic emission layer (EML), the OLED may include an electron transport layer (ETL) and a hole transport layer (HTL) between the anode and the cathode. The OLED may further include an electron injection layer (EIL) and a hole injection layer (HIL). When a voltage is applied between the OLED's anode and cathode, electrons generated by the cathode move to the EML through the EIL and the ETL, and holes generated by the anode move to the EML through the HIL and the HTL. The electrons and holes then recombine in the EML to generate light.

The pixel circuit 140 includes first and second transistors M1 and M2, a compensating circuit 144, and a capacitor C. Here, the first and second transistors M1 and M2 are p-type metal-oxide semiconductor field effect transistors (MOSFET). When the pixel circuit 140 includes p-type transistors, the second power source ELVSS may have a lower voltage level than the first power source ELVDD such as, for example, a ground voltage level.

The gate electrode of the first transistor M1 is coupled with the scan line Sn, the source electrode of the first transistor M1 is coupled with the data line Dm, and the drain electrode of the first transistor M1 is coupled with the gate electrode of the second transistor M2, that is, a first node N1. The first transistor M1 supplies the data signal from the data line Dm to the first node N1 in response to the scan signal supplied to the scan line Sn.

The gate electrode of the second transistor M2 is coupled with the first node N1, the source electrode of the second transistor M2 is coupled with the first power source ELVDD, and the drain electrode of the second transistor M2 is coupled with the anode of the OLED. The second transistor M2 controls the amount of current supplied from the first power source ELVDD to the OLED in accordance with the voltage corresponding to the digital data signal that is stored in the capacitor C.

The first electrode of the capacitor C is coupled with the first node N1, and the second electrode of the capacitor C is coupled with the first power source line ELVDD. The capacitor C stores the voltage corresponding to the digital data signal, which is supplied to the first node N1 via the first transistor M1, in the period where the scan signal is supplied to the scan line Sn. When the first transistor M1 turns off, the capacitor C maintains the state in which the second transistor M2 is turned on using the stored voltage in the sub-frames that constitute one frame.

In the light emitting display, the current that flows through the OLED is affected by the first power source from the first power source line ELVDD. Therefore, due to a voltage drop caused by the resistance of the first power source line ELVDD, when the first power sources that are applied to the pixel circuits 140 are not the same, it may not be possible to supply the desired amount of current to the OLED. Therefore, the voltage corresponding to the digital data signal that is stored in the capacitor C may vary with the position of each pixel 111 due to in the different voltage drops of the first power source lines ELVDD.

In order to compensate for the voltage drop of the first power source line ELVDD, the compensating circuit 144 is coupled between the compensating power source line VSUSn and the first node N1. The compensating circuit 144 supplies the compensating power source supplied by the compensating power source supply unit 160 to the first node N1 of each pixel 111.

Figure 5:
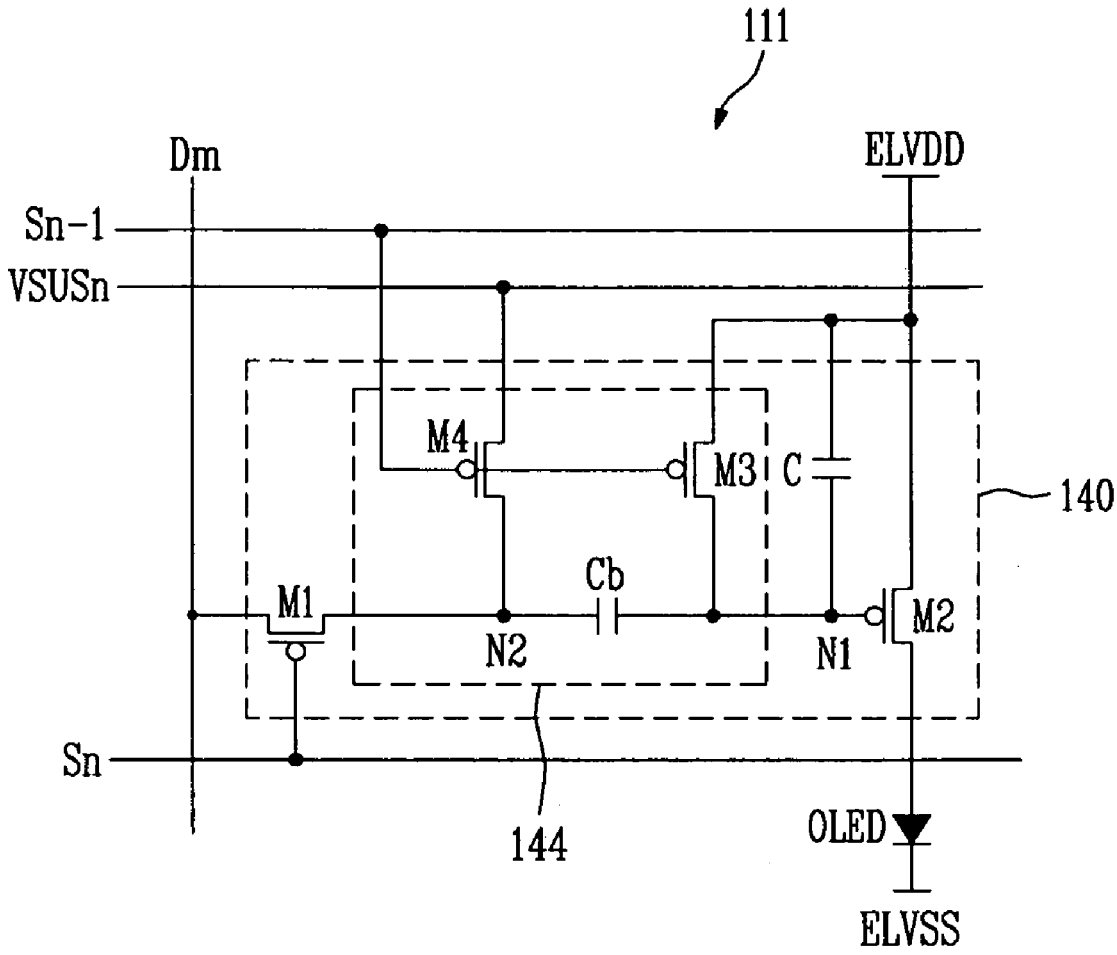
FIG. 5 is a circuit diagram showing a pixel circuit to which the internal circuit of the compensating circuit of FIG. 4 is applied.

FIG. 5 is a circuit diagram showing a pixel circuit to which the internal circuit of the compensating circuit of FIG. 4 is applied.

Referring to FIG. 5, the compensating circuit 144 includes third and fourth transistors M3 and M4 and a compensating capacitor Cb. Here, the third and fourth transistors M3 and M4 are p-type MOSFETs.

The gate electrode of the third transistor M3 is coupled with the N−1th scan line Sn−1, the source electrode of the third transistor M3 is coupled with the first power source line ELVDD, and the drain electrode of the third transistor M3 is coupled with the first node N1. The third transistor M3 supplies the first power source from the first power source line ELVDD to the first node N1 in accordance with the scan signal supplied to the N−1th scan line Sn−1.

The gate electrode of the fourth transistor M4 is coupled with the N−1th scan line Sn−1, the source electrode of the fourth transistor M4 is coupled with the compensating power source line VSUSn, and the drain electrode of the fourth transistor M4 is coupled with the second node N2, which is the drain electrode of the first transistor M1. The fourth transistor M4 supplies the compensating power source from the compensating power source line VSUSn to the second node N2 in accordance with the scan signal supplied to the N−1th scan line Sn−1.

The first electrode of the compensating capacitor Cb is coupled with the first node N1, and the second electrode of the compensating capacitor Cb is coupled with the second node N2. The compensating capacitor Cb stores a difference in voltage (i.e. a compensating voltage) between the first node N1 and the second node N2 in accordance with the scan signal supplied to the N−1th scan line Sn−1 and the digital data signal supplied by the data line Dm through the first transistor M1 in accordance with the scan signal supplied to the Nth scan line Sn.

A method of driving each pixel 111 is described below.

First, when the scan signal is supplied to the N−1th scan line Sn−1, the first power source is supplied to the first node N1, and the compensating power source is supplied to the second node N2. Then, when the scan signal is supplied to the Nth scan line Sn, the digital data signal is supplied to the second node N2. In this case, the voltage of the first node N1 changes in accordance with the amount of change in the voltage of the second node N2. Therefore, EQUATION 1 provides the voltage of the first node N1 when the scan signal is supplied to the Nth scan line Sn.

$$V_{N1}=ELVdd+\Delta V_{N2}+\text{Vdata}-Vn \quad \text{[EQUATION 1]}$$

wherein, ELVdd, Vdata, and Vn represent the first power source supplied to the first power source line ELVDD, the digital data signal supplied to the data line Dm, and the compensating power source supplied to the compensating power source line VSUSn, respectively.

Therefore, the first power source ELVdd is supplied to the second electrode of the capacitor C, and the voltage $V_{N1}$ of the first node N1, obtained by EQUATION 1, is supplied to the first electrode of the capacitor C. Accordingly, EQUATION 2 provides the voltage $V_C$ stored in the capacitor C.

$$V_c=ELVdd-(ELVdd+V\text{data}-Vn)=V\text{data}-\text{Vn} \quad \text{[EQUATION 2]}$$

Since the second transistor M2 is driven by the voltage $V_C$ stored in the capacitor C, the current supplied to the OLED may be obtained by EQUATION 3.

$$I_{OLED}=\frac{\beta}{2}(V_{GS2}-V_{TH2})^2=\frac{\beta}{2}((Vdata-Vn)-V_{TH2})^2 \quad \text{[EQUATION 3]}$$

wherein, $V_{GS2}$ and $V_{TH2}$ represent the voltage between the gate and source of the second transistor M2 and the threshold voltage of the second transistor M2, respectively.

As EQUATION 3 shows, the current $I_{OLED}$ that flows through the OLED is not affected by the first power source ELVdd supplied to the first power source line ELVDD.

Therefore, according to the light emitting display of the first exemplary embodiment of the present invention, the level of the compensating power source Vn supplied to the compensating power source line VSUSn varies with a digital data line signal Vdata so that it is possible to display a desired gray scale.

Figure 6:
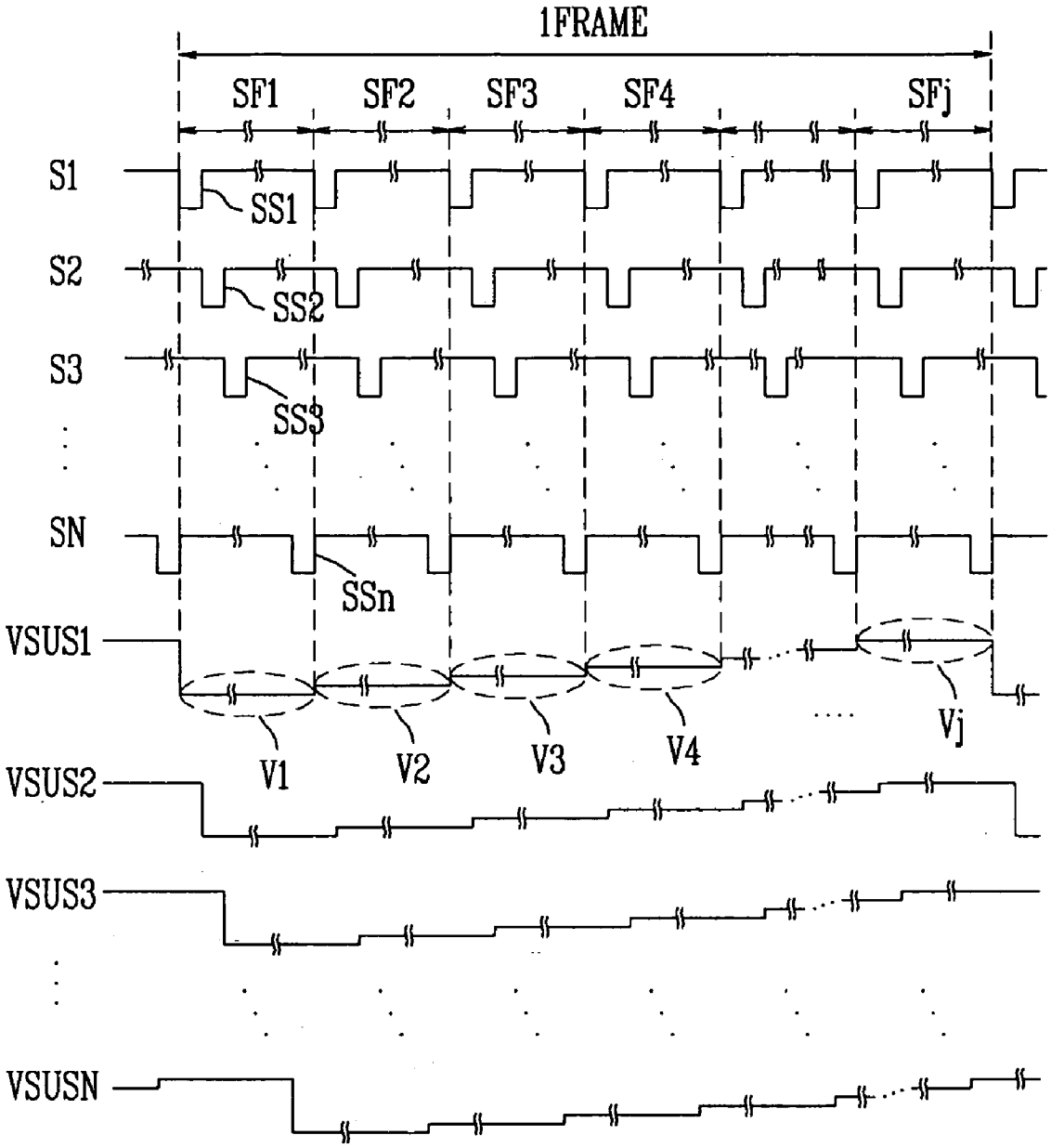
FIG. 6 shows waveforms that describe a method of driving the light emitting display according to the first exemplary embodiment of the present invention.

FIG. 6 shows waveforms that describe a method of driving the light emitting display according to the first exemplary embodiment of the present invention.

Referring to FIG. 6, in order to prevent non-uniform brightness caused by voltage drops of the first power source lines ELVDD, and to control the brightness of each OLED so that a desired gray scale is displayed, one frame is divided into a plurality of sub-frames SF1 to SFj to correspond to the bits of the i-bit digital data signals and to have the same emission time. Here, in the case of i-bit digital data signals, the first to jth sub-frames SF1 to SFj have gray scales corresponding to the brightness of different weight values. The ratio of the gray scales corresponding to the brightness of the first to jth sub-frames SF1 to SFj is $2^0:2^1:2^2:2^3:2^4:2^5:\ldots 2^i$.

The light emitting display according to the first exemplary embodiment of the present invention and the method of driving the same will be described below with reference to FIG. 5 and FIG. 6.

First, scan signals SS1 to SSn are sequentially supplied in the first sub-frame SF1 of a frame. The first compensating power source V1 is sequentially supplied to the compensating power source lines VSUS1 to VSUSN in synchronization with the scan signals SS1 to SSn.

Sequentially supplying the scan signals SS1 to SSn turns on the third and fourth transistors M3 and M4 included in each pixel 111. Here, the first power source from the first power source lines ELVDD is supplied to the first node N1 of each pixel 111, and the first compensating power source V1 from the compensating power source lines VSUS1 to VSUSn is supplied to the second node N2 of each pixel 111.

Then, the first transistor M1 is turned on by the scan signals SS1 to SSn. When the first transistor M1 is turned on, the first bit digital data signal supplied to the data lines D1 to DM is supplied to the second node N2. The voltage of the second electrode of the compensating capacitor Cb then changes into a data voltage, and the voltage of the first electrode of the compensating capacitor Cb changes by the amount of change of the voltage of the second electrode of the compensating capacitor Cb. EQUATION 4 provides the voltage $V_{N1}$ of the first electrode of the compensating capacitor Cb, that is, the first node N1.

$$V_{N1}=ELVdd+\Delta V_{N2}+V\text{data}-V1 \quad \text{[EQUATION 4]}$$

wherein, ELVdd, Vdata, and V1 represent the first power source supplied to the first power source line ELVDD, the first bit digital data signal among i bits, and the first compensating power source supplied to the compensating power source lines VSUS1 to VSUSN.

Therefore, the first power source ELVdd is supplied to the second electrode of the capacitor C, and the voltage $V_{N1}$ of the first node N1, obtained by EQUATION 4, is supplied to the first electrode of the capacitor C. Accordingly, EQUATION 5 provides the voltage $V_C$ stored in the capacitor C.

$$V_C=ELVdd-(ELVdd+V\text{data}-V1)=V\text{data}-V1 \quad \text{[EQUATION 5]}$$

Then, when the first transistor M1 turns off, the second transistor M2 is maintained to be turned on by the voltage stored in the capacitor C. That is, the second transistor M2 of each pixel 111 remains turned on by the voltage stored in the capacitor C so that current obtained by EQUATION 6 is supplied from the first power source line ELVDD to the OLED.

$$I_{OLED}=\frac{\beta}{2}(V_{GS2}-V_{TH2})^2=\frac{\beta}{2}(Vdata-V1)-V_{TH2})^2 \quad \text{[EQUATION 6]}$$

As EQUATION 6 shows, the current $I_{OLED}$ that flows through the OLED is not affected by the first power source ELVdd supplied to the first power source line ELVDD.

Therefore, each OLED receives the current corresponding to the first bit digital data signal and the first compensating power source V1, regardless of the voltage drops of the first power sources, in the first sub-frame SF1 to emit light with a brightness corresponding to either the gray scale of 0 or $2^0$. That is, each OLED emits light with the brightness corresponding to the gray scale $2^0$ when the first bit digital data signal is 0 and does not emit light when the first bit digital data signal is 1.

In the second sub-frame SF2 of the frame, the second compensating power source V2, which is higher than the first compensating power source V1, is supplied to the compensating power source lines VSUS1 to VSUSN. After storing the voltage corresponding to the second compensating power source V2 and a second bit digital data signal among i bits in the capacitor C, the second transistor M2 of each pixel 111 is then driven using the voltage stored in the capacitor C. Therefore, in the second sub-frame SF2, each OLED receives a current corresponding to the second bit digital data signal and the second compensating power source V2, as each OLED receives the current corresponding to the first bit digital data signal and the first compensating power source V1 in the first sub-frame SF1, to emit light with a brightness corresponding to either the gray scale of 0 or $2^1$.

In the third to jth sub-frames SF3 to SFj of the frame, the third to jth compensating power sources V3 to Vj, which become higher toward the uppermost bit, are supplied to the compensating power source lines VSUS1 to VSUSN. After storing the voltages corresponding to the compensating power sources V3 to Vj and the third to $i^{th}$ bit digital data signals in the capacitor C, as the voltages corresponding to first and second compensating power sources V1 and V2 and the first and second bit digital data signals are stored in the capacitor C in the first and second sub-frames SF1 and SF2, the second transistor M2 of each pixel 111 is then driven by the voltages stored in the capacitor C. Therefore, each OLED receives a current corresponding to the third to $i^{th}$ bit digital data signals and the third to $j^{th}$ compensating power sources V3 to Vj in the third to $j^{th}$ sub-frames, as each OLED receives the currents corresponding to the first and second bit digital data signals and the first and second compensating power sources V1 and V2 in the first and second sub-frames, to emit light with a brightness corresponding to the gray scales of 0 or $2^2$ to $2^i$, respectively.

According to the light emitting display of the first exemplary embodiment of the present invention and the method of driving the same, voltage drops of the first power source lines ELVDD are compensated for by using the compensating circuit 144 and the different-level compensating power sources V1 to Vj in the sub-frames SF1 to SFj so that images may be displayed with a desired gray scale by the sum of brightness in accordance with the emission of the OLEDs in the sub-frames SF1 to SFj. Here, a digital driving method, which utilizes digital data signals, is used to decrease non-uniformity in images caused by voltage drops in power source lines. According to the first embodiment of the present invention and the method of driving the same, in the digital driving method, the sub-frames SF1 to SFj have the same emission periods in order to secure enough time to display the gray scales of the sub-frames SF1 to SFj.

Figure 7:
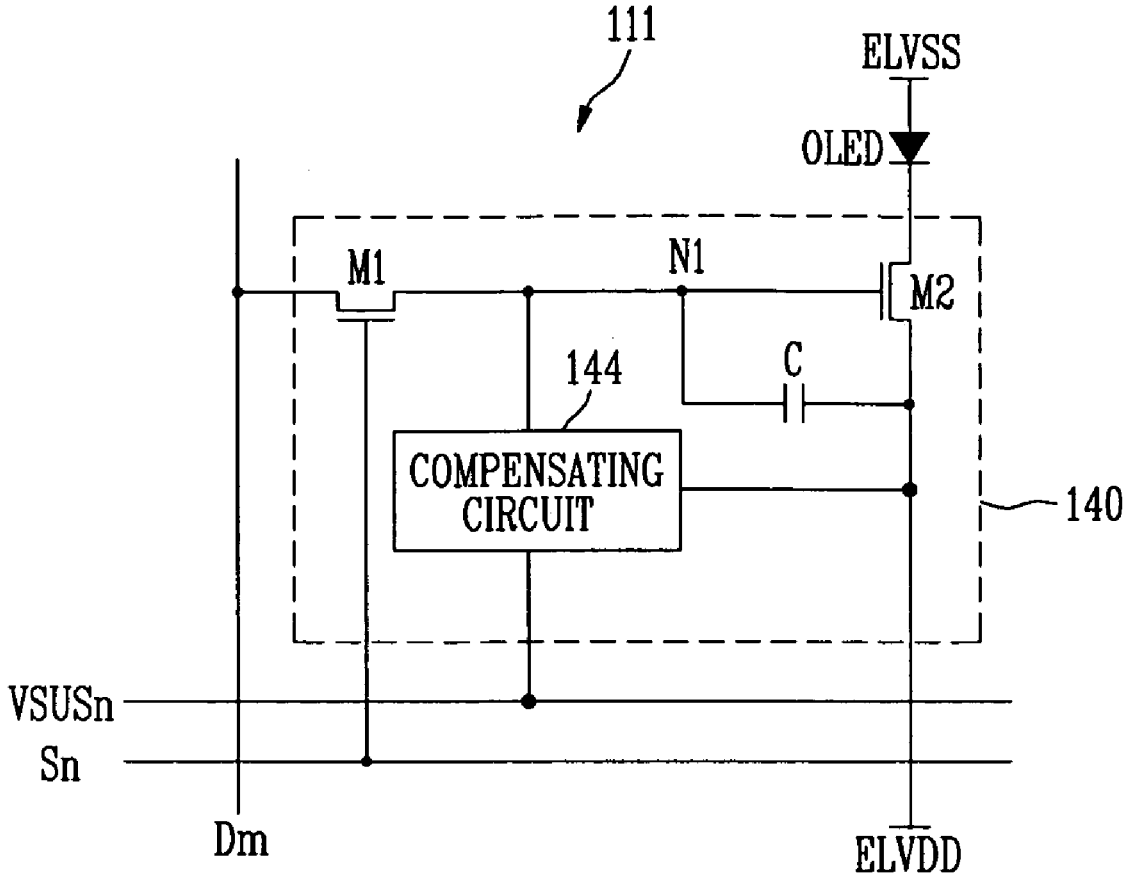
FIG. 7 shows a pixel of a light emitting display according to a second exemplary embodiment of the present invention.
Figure 8:
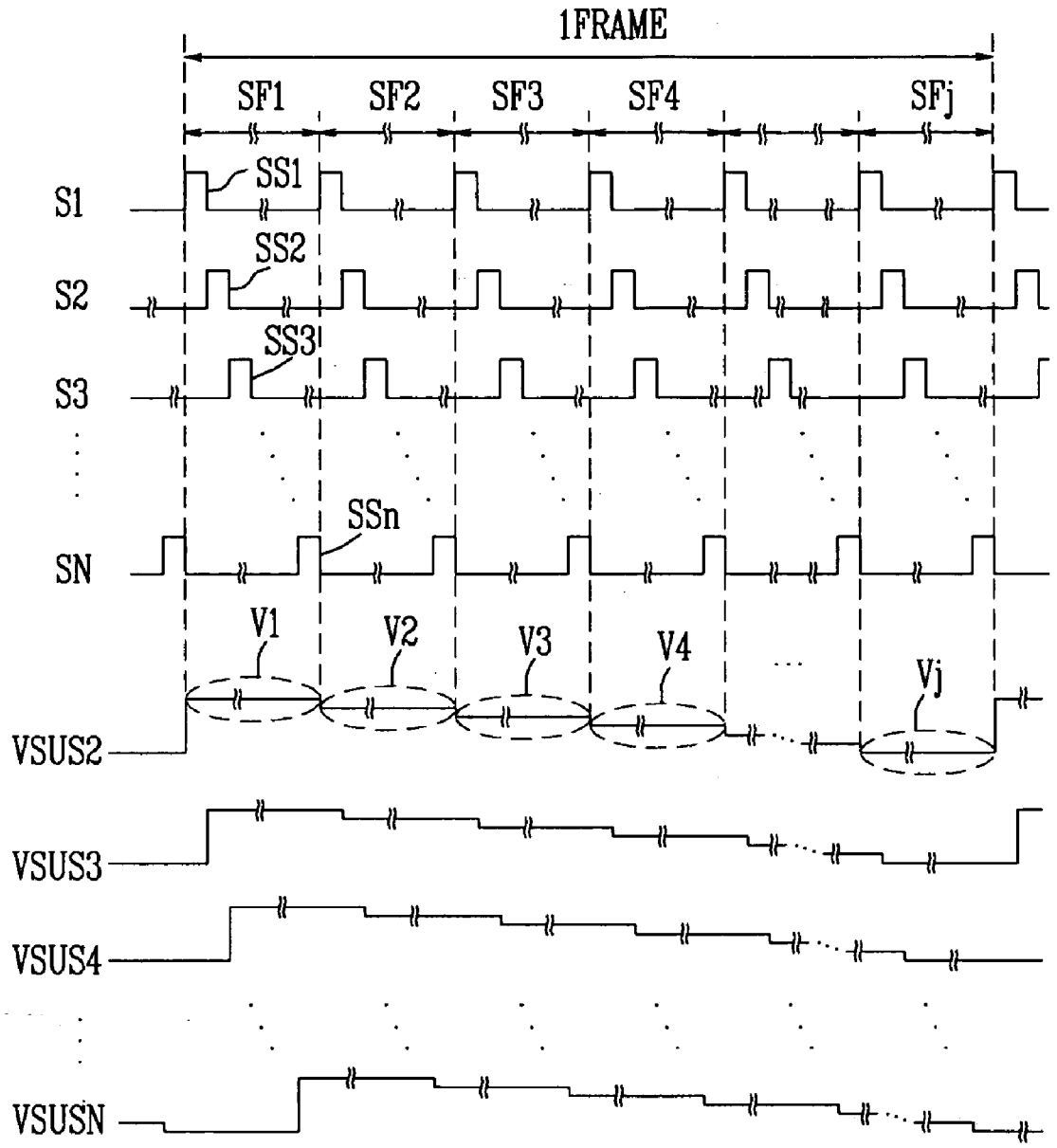
FIG. 8 shows waveforms that describe a method of driving the light emitting display according to the second exemplary embodiment of the present invention.

FIG. 7 shows a pixel of a light emitting display according to a second exemplary embodiment of the present invention. FIG. 8 shows waveforms that describe a method of driving the light emitting display according to the second exemplary embodiment of the present invention.

Referring to FIG. 7 and FIG. 8, the pixel of the light emitting display according to the second exemplary embodiment of the present invention is the same as the pixel of the light emitting display according to the first exemplary embodiment of the present invention except for the conductivity types of the transistors M1 and M2 of the pixel circuit 140 and the transistors M3 and M4 of the compensating circuit 144.

Hence, the scan signals for driving the n-type transistors M1, M2, M3 and M4 differ from the scan signals for driving the p-type transistors M1, M2, M3 and M4. Accordingly, anyone skilled in the art can easily understand the second embodiment of the present invention by the description of the first embodiment of the present invention. Therefore, the description of the light emitting display according to the first exemplary embodiment of the present invention, in which the p-type transistors are included, is applicable for the second exemplary embodiment of the present invention.

While it is described above that the sub-frames have the same emission period, they may have different emission periods in order to display gray scales and to improve picture quality.

The light emitting display according to exemplary embodiments of the present invention and the method of driving the same may be applied to any display that controls currents to display images.

As described above, in the light emitting display according to exemplary embodiments of the present invention and a method of driving the same, currents corresponding to digital data signals and compensating power sources may be supplied to the OLEDs in the sub-frames, respectively, using the compensating circuit regardless of the voltage drops of the first power source lines, so that it is possible to display images of a desired gray scale. Therefore, according to the present invention, images are displayed using the digital data signals and the compensating power sources in order to minimize non-uniformity in images caused by deviation in the characteristics of the transistors.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A light emitting display, comprising:

a plurality of pixels arranged in regions partitioned by a plurality of scan lines to which scan signals are supplied, a plurality of data lines to which data signals are supplied, a plurality of compensating power source lines to which compensating power sources are supplied, and a plurality of first power source lines, wherein a pixel comprises:

a pixel circuit for outputting currents corresponding to the compensating power sources and the data signals in a plurality of sub-frames included in a frame; and an organic light emitting diode (OLED) that emits light corresponding to the current output from the pixel circuit.

2. The light emitting display of claim 1, wherein the current output from the pixel circuit corresponds to a difference in voltage between the compensating power source and the data signal.

3. The light emitting display of claim 1, wherein the pixels display desired gray scales by a sum of brightness in accordance with emission of OLEDs in the sub-frames.

4. The light emitting display of claim 1, wherein the data signals are digital data signals including i bits corresponding to the sub-frames, and i is a positive integer.

5. The light emitting display of claim 4, wherein levels of the compensating power sources become higher toward an uppermost bit of the digital data signals.

6. The light emitting display of claim 1, wherein the first power source lines are arranged substantially parallel with the data lines.

7. The light emitting display of claim 1, wherein the compensating power source lines are arranged substantially parallel with the scan lines.

8. The light emitting display of claim 1, further comprising:

a second power source line for supplying a second power source to a cathode of the OLED, wherein the second power source differs from a first power source supplied to the first power source line.

9. The light emitting display of claim 8, wherein the pixel circuit comprises:

a first transistor controlled by a scan signal supplied to a present scan line to output the data signal supplied to the data line;

a second transistor for controlling an amount of current supplied from the first power source line to the OLED in accordance with a voltage between a gate electrode and a source electrode of the second transistor;

a compensating circuit controlled by a scan signal supplied to a previous scan line to store a compensating voltage between the compensating power source and the first power source; and a capacitor for storing a voltage corresponding to the data signal from the first transistor and the compensating power source to control the voltage between the gate electrode and the source electrode of the second transistor.

10. The light emitting display of claim 9, wherein the compensating circuit comprises:

a compensating capacitor electrically coupled between a first node that is the gate electrode of the second transistor and a second node that is an output of the first transistor;

a third transistor controlled by the scan signal supplied to the previous scan line and coupled between the first node and the first power source line; and a fourth transistor controlled by the scan signal supplied to the previous scan line and coupled between the second node and the compensating power source line.

11. The light emitting display of claim 9, wherein the compensating power source is supplied to the compensating power source line in synchronization with the scan signal supplied to the previous scan line.

12. A light emitting display, comprising:

an image display unit comprising a plurality of pixels arranged in regions partitioned by a plurality of scan lines, a plurality of data lines, a plurality of first power source lines, and a plurality of compensating power source lines, the pixels receiving currents corresponding to compensating power sources supplied to the compensating power source lines and data signals supplied to the data lines from the first power source lines to emit light;

a scan line driver for supplying scan signals to the scan lines;

a data driver for supplying the data signals to the data lines;

a compensating power source supply unit for supplying the compensating power sources corresponding to sub-frames of a frame to the compensating power source lines; and a first power source supply unit for supplying a first power source to the first power source line.

13. The light emitting display of claim 12, wherein the current received by each pixel corresponds to a difference in voltage between the compensating power source and the data signal.

14. The light emitting display of claim 12, wherein the pixels display a desired gray scale by a sum of brightness of light emitted in the sub-frames.

15. The light emitting display of claim 12, wherein the data signals are digital data signals including i bits corresponding to the sub-frames, and i is a positive integer.

16. The light emitting display of claim 15, wherein levels of the compensating power sources become higher toward an uppermost bit of the digital data signals.

17. The light emitting display of claim 12, wherein the first power source lines are arranged substantially parallel with the data lines.

18. The light emitting display of claim 12, wherein the compensating power source lines are arranged substantially parallel with the scan lines.

19. The light emitting display of claim 12, wherein the compensating power source supply unit comprises:

a compensating power source generator for generating different compensating power sources corresponding to the sub-frames;

a shift register for generating a selection signal; and a compensating power source selector for selecting one of the different compensating power sources in accordance with the selection signal to sequentially supply the selected one of the different compensating power sources to the plurality of compensating power source lines.

20. The light emitting display of claim 12, further comprising:

a second power source supply unit for supplying a second power source to a second power source line coupled with each pixel, wherein the second power source differs from the first power source.

21. The light emitting display of claim 12, wherein a pixel comprises:

a pixel circuit for outputting the current corresponding to the compensating power source and the data signal in each sub-frame from the first power source line; and an organic light emitting diode (OLED) for emitting light corresponding to the current output from the pixel circuit.

22. The light emitting display of claim 21, wherein the pixel circuit comprises:

a first transistor controlled by a scan signal supplied to a present scan line to output the data signal supplied to the data line;

a second transistor for controlling an amount of current supplied from the first power source line to the OLED in accordance with a voltage between a gate electrode and a source electrode of the second transistor;

a compensating circuit for storing a compensating voltage between the compensating power source and the first power source in accordance with a scan signal supplied to a previous scan line; and a capacitor for storing a voltage corresponding to the data signal from the first transistor and the compensating power source to control the voltage between the gate electrode and the source electrode of the second transistor.

23. The light emitting display of claim 22, wherein the compensating circuit comprises:

a compensating capacitor electrically coupled between a first node that is the gate electrode of the second transistor and a second node that is an output of the first transistor;

a third transistor controlled by the scan signal supplied to the previous scan line and coupled between the first node and the first power source line; and a fourth transistor controlled by the scan signal supplied to the previous scan line and coupled between the second node and the compensating power source line.

24. The light emitting display of claim 22, wherein the compensating power sources are supplied to the compensating power source lines in synchronization with the scan signal supplied to the previous scan line.

25. A method of driving a light emitting display comprising a plurality of pixels arranged in regions partitioned by a plurality of scan lines, a plurality of data lines, a plurality of first power source lines, and a plurality of compensating power source lines, the method comprising:

supplying compensating power sources to the compensating power source lines in a plurality of sub-frames included in a frame, the compensating power sources having different voltage levels in each sub-frame;

storing a compensating voltage between the compensating power source and a first power source supplied to the first power source line in a first capacitor included in a pixel;

supplying data signals to the data lines;

storing a voltage corresponding to the data signal and the compensating power source in a second capacitor included in the pixel; and supplying a current corresponding to the voltage stored in the second capacitor to an organic light emitting diode (OLED).

26. The method of claim 25, wherein the current supplied to the OLED corresponds to a difference in voltage between the compensating power source and the data signal.

27. The method of claim 25, wherein the pixels display desired gray scales by a sum of brightness in accordance with emission of OLEDs in the sub-frames.

28. The method of claim 25, wherein the data signals are digital data signals including i bits corresponding to the sub-frames, and i is a positive integer.

29. The method of claim 28, wherein levels of the compensating power sources become higher toward an uppermost bit of the digital data signals.

30. The method of claim 27, wherein the compensating power sources are supplied to the compensating power source lines in synchronization with scan signals supplied to the scan lines.

* * * * *